United States Patent [19]

Elliott

[11] 4,366,595

[45] Jan. 4, 1983

[54] DOOR CLOSER

[75] Inventor: James D. Elliott, Cheyenne, Wyo.

[73] Assignee: AMF Incorporated, White Plains, N.Y.

[21] Appl. No.: 178,320

[22] Filed: Aug. 15, 1980

[51] Int. Cl.[3] ..... E05F 15/12; E05F 15/18; E05F 15/20

[52] U.S. Cl. ..... 16/71; 49/30

[58] Field of Search ..... 16/48.5, 49, 71, 75, 16/76; 49/30

[56] References Cited

U.S. PATENT DOCUMENTS

| | | | |
|---|---|---|---|
| 1,827,595 | 10/1931 | MacGuire | 16/49 |
| 2,591,693 | 4/1952 | Gatesy | 49/30 X |
| 2,895,728 | 7/1959 | Edelman | 49/30 X |
| 4,287,639 | 9/1981 | Denton | 16/71 X |

FOREIGN PATENT DOCUMENTS

| | | | |
|---|---|---|---|
| 1212443 | 3/1966 | Fed. Rep. of Germany | 16/76 |
| 1057063 | 2/1967 | United Kingdom | 49/30 |

*Primary Examiner*—Wm. Carter Reynolds

*Attorney, Agent, or Firm*—David E. Dougherty; Charles J. Worth

[57] ABSTRACT

An automatic motorized door closure having an arm freely movable on a motor shaft in response to opening a door and after a time delay being connected to the motor shaft and automatically moving the door to a closed position.

5 Claims, 5 Drawing Figures

DOOR CLOSER

This invention relates to a door closer, and more particularly, to an automatic motorized door closer with a built in time delay.

It is an object of this invention to provide an improved and low cost automatic door closer.

The invention will be best understood by considering the following detailed description of one embodiment thereof taken in connection with the accompanying two sheets of drawing in which.

Figure 1:
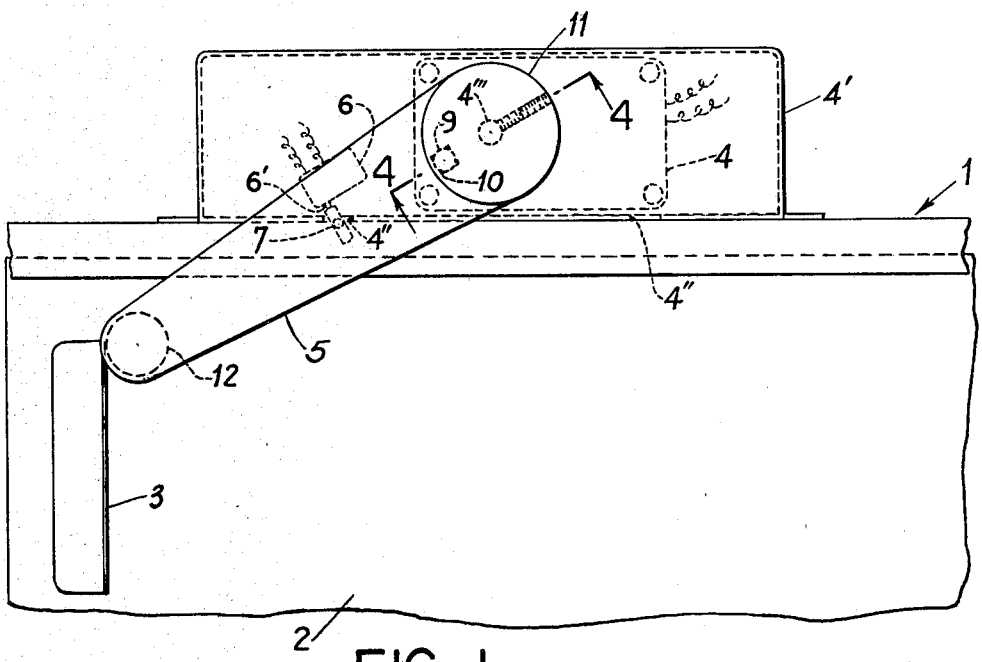
FIG. 1 is a broken away front view illustration of one form of the invention with the door closed.
Figure 2:
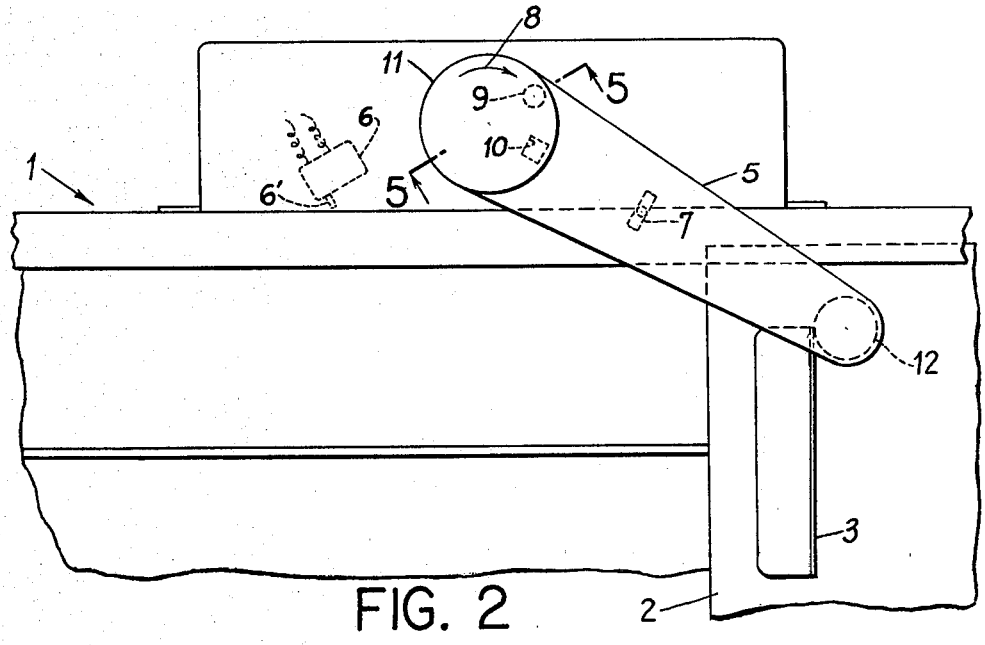
FIG. 2 is a view similar to that of FIG. 1 but with the door full open.
Figure 3:
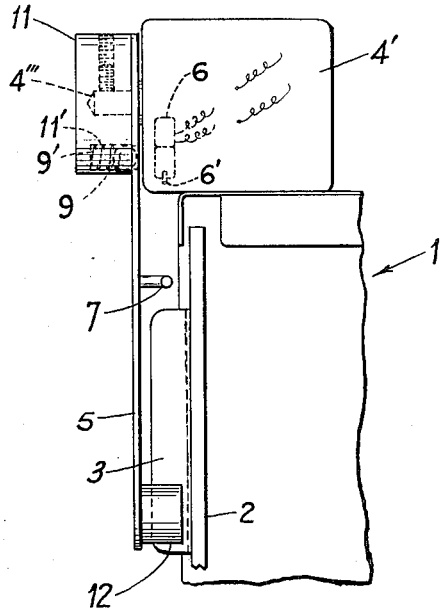
FIG. 3 is a side view with the parts thereof shown in the position they would have with the door about half way closed.

Turning now first to FIGS. 1–3, illustrated therein is a food cabinet or the like 1 having a sideways sliding door 2. Positioned on the door is a fin, finger, tab or the like 3; and positioned on the top of cabinet is a small gear motor 4. The fin 3, which is also a handle for the door 2, and the motor 4, are interconnected by an arm 5.

The motor 4 is in a housing 4' which contains a motor on-off switch 6. A pin or the like 7 is mounted at about the center of arm 5 and turns the motor 4 on or off at the switch 6. As seen in FIG. 1, in this position of the device the pin 7 protrudes into the motor housing 4' through a small aperture 4'' formed in the bottom thereof to strike a button 6' on the switch 6. In this position the motor is de-energized. When the pin 7 is out of contact with the switch 6 the motor is energized, which is the FIGS. 2 and 3 position of the device. The necessary electrical connections between the switch 6 and motor 4 are contained in the housing 4' so that this is a self-contained subassembly that can be readily mounted on the top of cabinet 1 or other desired location depending upon what kind of door movement is to be controlled.

Briefly, in the illustrated form of the invention the door 2 is opened by sliding it to the right, from the FIG. 1 position to the FIG. 2 position. This causes the handle 3 to swing the arm 5 to the right or counterclockwise. When the pin 7 on arm 5 leaves switch button 6' the switch 6 closes a circuit to energize the motor 4. The motor 4 turns clockwise as shown by arrow 8 in FIG. 2 until such time as a spring biased detent ball 9 carried by the motor becomes engaged with a ball detent 10 on the arm 5. At this point the motor carries the arm 5 with it to the left or clockwise to move the door 2 to the left to closed position. The details of this will now be described.

Figure 4:
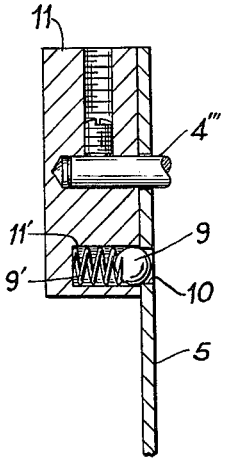
FIG. 4 is an enlarged sectional view along the section line 4—4 of FIG. 1.
Figure 5:
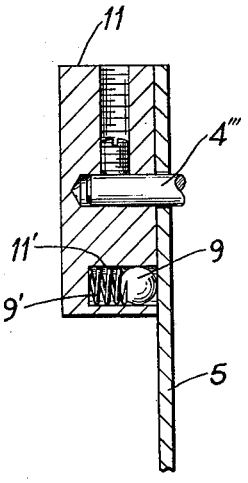
FIG. 5 is a view similar to that of FIG. 4 but along the section line 5—5 of FIG. 2.

Turning specifically to FIGS. 4 and 5, the motor 4 has a shaft 4''' protruding therefrom and fixed thereto to always move therewith is a drive disc or the like 11. A blind hole 11' formed in disc 11 adjacent its periphery contains the aforementioned detent ball 9, which is biased out of hole 11' by a coiled back-up spring 9' for ball 9.

The upper end of arm 5 is apertured and at one end is freely rotatably mounted on the motor shaft 4''' between the drive disc 11 and the motor housing 4'. The ball detent 10 is formed on the arm at the same radial distance from shaft 4''' as the detent ball 9. When the ball 9 is out of the detent 10 the arm is not turned by the motor 4. However, when the ball 9 enters the detent 10, which in the drawings is illustrated as comprising a square hole or notch in the arm 5, the motor 4 then carries arm 5 with it in a clockwise direction to move the door closed. A roller, knob or the like 12 at the outer end of arm 5 is in engagement with the handle fin 3. As the arm 5 and handle fin 3 move to the left to close the door the roller runs down along the fin 3, see FIG. 3, and then runs up the fin upon completion of door closing movement, see FIG. 1.

A complete operating cycle will now be described. Assuming the starting position is FIG. 1, the door is moved to the right to FIG. 2. The ball 9 stays in the FIG. 1 position but the detent moves to the FIG. 2 position along with arm 5. Since pin 7 has left switch 6 the motor 4 starts turning the drive disc 11 clockwise towards the detent 10, see FIG. 2. When the ball 9 comes around to enter the detent 10 then motor 4 carries arm 5 with it back from the FIGS. 2 and 3 position to FIG. 1. When the door is fully closed the pin 7 hits switch 6 to turn motor 4 off. However, due to its rotational inertia it actually carries the ball just past the FIG. 1 position, clockwise, to move the ball past or disengaged from the detent 10. This slot is a low torque position between disc 11 and arm 5, comparable to FIG. 5. So, when the arm 5 is swung to the right when the door is opened the detent means does not hinder this rather free swinging of the arm 5 to the right. When the motor 4 is turning clockwise since the detent means is not engaged, which is a low torque condition between the disc 11 and arm 5, the arm 5 is not being moved. Thus, there is a built in time delay before automatic closing movement of the door starts. This of course is determined largely by the speed of the motor, which in one constructed form thereof was about 6 rpm. By considering FIGS. 1 and 2 it will be seen that the ball has to move about 270 degrees clockwise at which point it will enter or engage the detent or ball slot 10. In this condition, namely detent engaged position of parts 9 and 10, there is relative high torque (see FIG. 4) or drive relationship causing the disc 11 and arm 5 to be driven in unison by the motor 4. So, the disc 11 will now carry the arm 5 clockwise with it from full open position (FIG. 2) through about half open position (FIG. 3) back to door closed position (FIG. 1). When the arm 5 returns to FIG. 1 pin 7 strikes switch 6 to shut motor 4 off but the disc 11, due to motor inertia, continues to travel slightly beyond FIG. 1 to take the ball 9 out of detent 10 so the parts are return to a low torque condition so that door 2 can once again be freely opened without hindrance from the detent means. Obviously the detent means has to be disengaged upon completion of door closing movement. If not, then when one opened the door the detent means would move the disc counterclockwise, in which event the arm 5 would start to move to clsed position immediately with no time delay, or the parts could lock together, assuming the motor would not turn in reverse, so that the door could not be opened.

In the use of food display cases, controlled humidity cabinets and controlled temperature cabinets, such as are used for keeping baked goods at ideal serving condition, there is a need for an automatic door closing system. This is because restaurant people are often under considerable time pressure and forget to close the doors or do not have a free hand to do so. Usual door closing systems rely upon some type of damping to close the door slowly enough to prevent slamming but this is insufficient. The ideal system would: (1) have the door open easily to the minimum dimension consistent with removing the product, (2) hold the door open long enough to remove the product, (3) close the door at a predetermined rate of speed as quickly as possible consistent with low impact to keep heat, humidity or cold within the cabinet, (4) use minimum force to avoid hazard to personnel, (5) not intefere with removing doors for cleaning, (6) not require "built in" design, so that it might be offered as an option with a specific cabinet or as an add on to a cabinet already built and (7) be simple, reliable and low in cost. My invention incorporates all 7 of the above requirements. Additionally, the arm 5 is not in any way fixed to the door 2. This permits the door to be closed manually without waiting for the motor 4 to close it. In other words, the door 2 can be manually moved to the left from the FIG. 2 to the FIG. 1 position and this will not affect the arm 5 and the parts to which it is connected. It will merely cycle as before and automatically return to the described FIG. 1 position in readiness for an automatic door closing movement with built in time delay.

I claim:

1. An automatic door closer for a cabinet having a door, comprising, an electric motor on said cabinet and having a shaft protruding therefrom, a door closing arm extending between said motor and door, said arm being rotatably mounted at one end thereof on said shaft, the other end of said arm extending to said door, means on said door for moving said arm in one direction about said shaft in response to opening movement of said door, and drive means on said shaft being driven by said motor and engaging after a time delay and moving said arm in an opposite direction to close said door and to disengage said arm after said door is closed.

2. In an automatic door closer as in claim 1, said drive means comprising a drive disc fixed to said shaft, said one arm end being freely rotatably mounted on said shaft opposite said drive disc, and alternately disengaged and engaged spring biased detent means between said one arm end and drive disc to first permit said arm to move in said one direction relative said drive disc and then in said opposite direction with said drive disc.

3. In an automatic door closer as in claim 2, said alternately disengaged and engaged spring biased detent means comprising a bore formed in said disc opposite said one arm end, a detent ball in said bore, a back up spring in said bore urging said ball out of said bore against said one arm end, and a detent slot in said arm which is adapted to be engaged by said ball.

4. In an automatic door closer as in claim 3, said ball and slot having been disengaged after movement of said arm in said opposite direction and remaining disengaged when said arm is moved in said one direction corresponding to opening movement of said door, and said ball and slot being engaged when said arm is moved by said drive disc in said opposite direction corresponding to closing movement of said door by said motor, an on-off switch on said cabinet for controlling said motor, a switch actuating finger on said arm, said finger being engaged with said switch to turn said motor off when said door is closed, and said finger being disengaged with said switch to turn said motor on when said door is opened.

5. In an automatic door closer as in claim 4, said ball and detent slot being disengaged when said door is closed, said slot being moved by said arm in said one direction away from said ball when said door is opened, and said motor rotating said disc in said opposite direction causing said ball to move and engage said slot and further move and drive said arm in unison with said disc to close said door, the time it takes for said ball to move and engage said slot comprising said time delay between opening and automatic closing of said door.

* * * * *